US008196624B2

(12) United States Patent
Farnworth et al.

(10) Patent No.: US 8,196,624 B2
(45) Date of Patent: Jun. 12, 2012

(54) PENCIL SHARPENER

(75) Inventors: Stuart David Farnworth, Westport, CT (US); Javier Verdura, Milford, CT (US); Jonathan A. Lee, Milford, CT (US)

(73) Assignee: Acme United Corporation, Fairfield, CT (US)

( * ) Notice: Subject to any disclaimer, the term of this patent is extended or adjusted under 35 U.S.C. 154(b) by 26 days.

(21) Appl. No.: 12/380,190

(22) Filed: Feb. 25, 2009

(65) Prior Publication Data

US 2010/0212781 A1 Aug. 26, 2010

(51) Int. Cl.
*B43L 23/00* (2006.01)

(52) U.S. Cl. ..... 144/28.72

(58) Field of Classification Search ..... 144/28.1, 144/28.11–28.72; 30/453, 454, 457–459
See application file for complete search history.

(56) References Cited

U.S. PATENT DOCUMENTS

| | | | | |
|---|---|---|---|---|
| 3,237,607 | A * | 3/1966 | O'Brien | 144/28.71 |
| 3,678,975 | A * | 7/1972 | Imanishi et al. | 144/28.5 |
| 4,966,208 | A * | 10/1990 | Uang | 144/28.72 |
| 6,286,218 | B1 * | 9/2001 | Luttgens | 30/454 |
| 6,470,929 | B2 * | 10/2002 | Fregeolle | 144/28.72 |
| 6,637,481 | B2 * | 10/2003 | Mak et al. | 144/28.5 |
| 6,845,795 | B2 * | 1/2005 | Lammers et al. | 144/28.5 |
| 7,654,179 | B2 * | 2/2010 | Parrish et al. | 83/13 |
| D616,942 | S * | 6/2010 | Farnworth et al. | D19/73 |

* cited by examiner

*Primary Examiner* — Shelley Self
(74) *Attorney, Agent, or Firm* — Alix, Yale & Ristas, LLP

(57) ABSTRACT

A pencil sharpener has an electrical motor which drives a sharpening assembly. The end of the pencil to be sharpened is inserted downwardly into an opening in the top surface. Shavings from the sharpening process are deposited in a drawer-like receptacle below the sharpening assembly. A switch is provided so that the sharpening assembly will not be activated when the receptacle drawer is removed for disposal of the shavings.

18 Claims, 9 Drawing Sheets

PENCIL SHARPENER

BACKGROUND

This disclosure relates generally to pencil sharpeners. More particularly, this disclosure relates to pencil sharpeners having an electrically powered rotary cutting assembly which is automatically activated for commencing sharpening.

In pencil sharpeners to which the present disclosure relates, such as U.S. patent application Ser. No. 11/451,753 filed Jun. 12, 2006 and assigned to the assignee of the present invention, the end of a pencil to be sharpened is inserted into an opening disposed through an upper housing surface. A rotary cutting assembly is automatically activated to sharpen the pencil, and upon completion of the sharpening, the cutting assembly is deactivated. In some instances, the cutting assembly is reversed for partially expelling the sharpened point from the cutting assembly. The shavings may be typically directed outwardly from the side of the cutting assembly, wherein they are collected in an annular receptacle which may be vertically removed for emptying the shavings.

SUMMARY

Briefly stated, a pencil sharpener in one preferred form comprises a housing having a base and a top with an opening. The housing is disposable in a generally upright orientation. A receptacle has an open top and is transversely slidably receivable in the housing. An electrically operated sharpener assembly is disposed in the housing above the receptacle. A first switch is responsive to the insertion of an end of a pencil into the opening. When a pencil end is inserted into the opening, the sharpener assembly is activated to sharpen the pencil, and the shavings from the pencil fall into the receptacle.

A second switch prevents activation of the sharpener assembly when the receptacle is displaced from the closed position. The receptacle has a drawer construction with a frontal surface which is transparent or semi-transparent. The base comprises a platform with a resilient tongue having a catch. The receptacle has an indentation which is engaged by the catch in the closed position. The top and the base each have a generally elliptically shaped edge. The top has a generally elliptical shape with a concave depression. The opening is offset from the center of the top.

In one embodiment the receptacle has an integral tab which projects rearwardly and is received in a slot for detection by the second switch. In another embodiment the second switch has a leaf which is engaged by the receptacle in the closed position.

The receptacle includes a pair of laterally spaced sides which include lower channels. The lower channels engage a contoured interior projection of the housing. The housing has a pair of opposed indentations adjacent the receptacle frontal surface in the closed receptacle position. The interior of the housing forms a chute for shavings produced by the sharpener assembly.

DETAILED DESCRIPTION OF THE PREFERRED EMBODIMENTS

Figure 1:
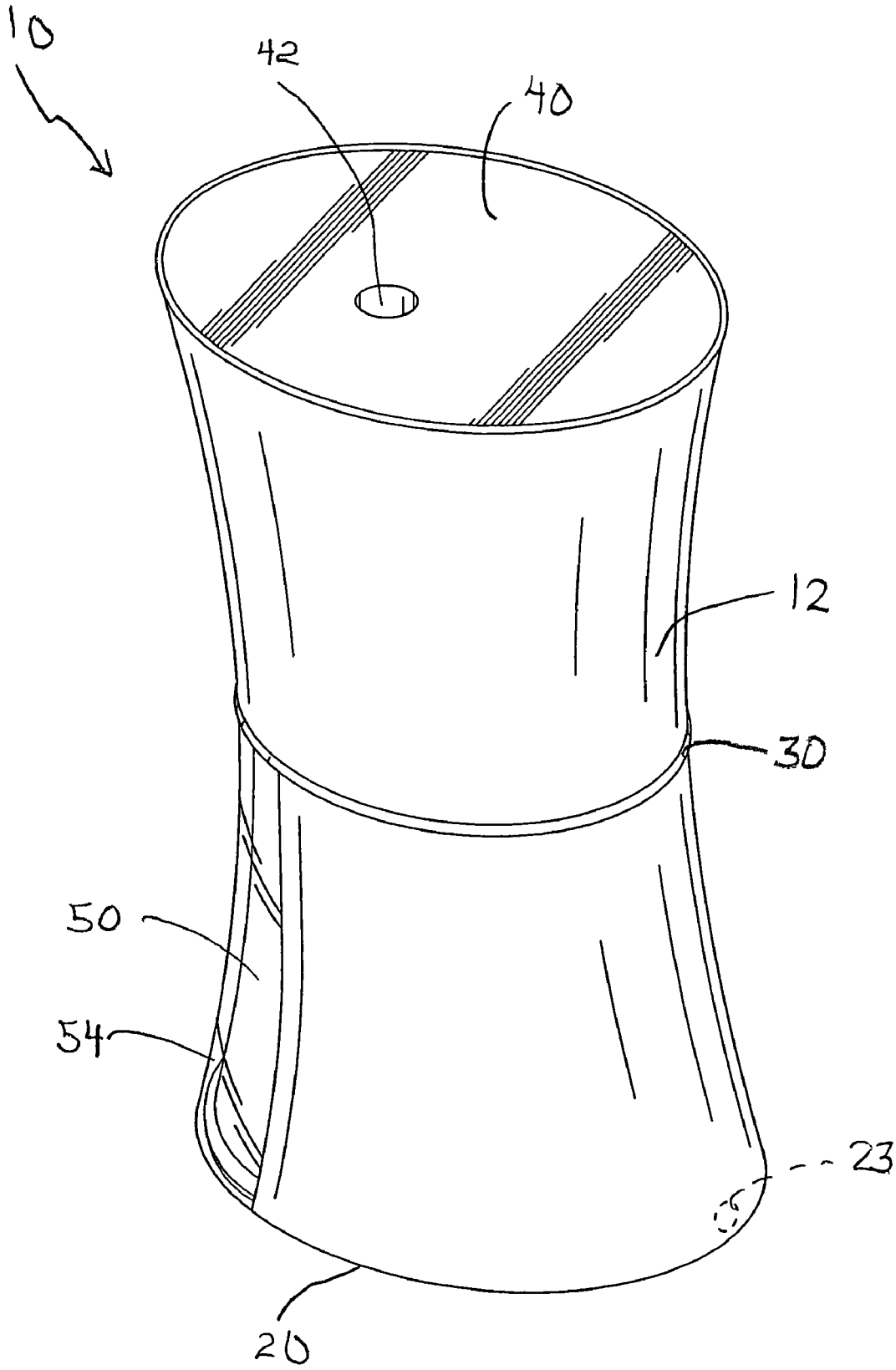
FIG. 1 is a perspective view of a pencil sharpener.

With reference to the drawings wherein like numerals represent like parts throughout the several figures, an electrically operated pencil sharpener is generally designated by the numeral 10 (FIGS. 1-5), and a battery powered pencil sharpener is generally designated by the numeral 110 (FIGS. 6-9). The pencil sharpeners 10, 110 have an aesthetically pleasing curvilinear, upright housing 12, 112 which may be generally described as having the shape of a sleek hourglass. Each housing 12, 112 preferably has a molded construction and extends from a support base 20, 120 to a top 40, 140 with a recessed vertical medial portion 30, 130. Each top 40, 140 has a generally elliptical shape with a slight concave depression and has an off center pencil opening 42, 142. The end of the pencil to be sharpened (not illustrated) is inserted downwardly into the pencil opening 42, 142. A receptacle, which takes the form of a transversely slidable drawer 50, 150 receives the shavings (not illustrated) from the sharpener and is removable for disposing of the shavings.

Figure 5:
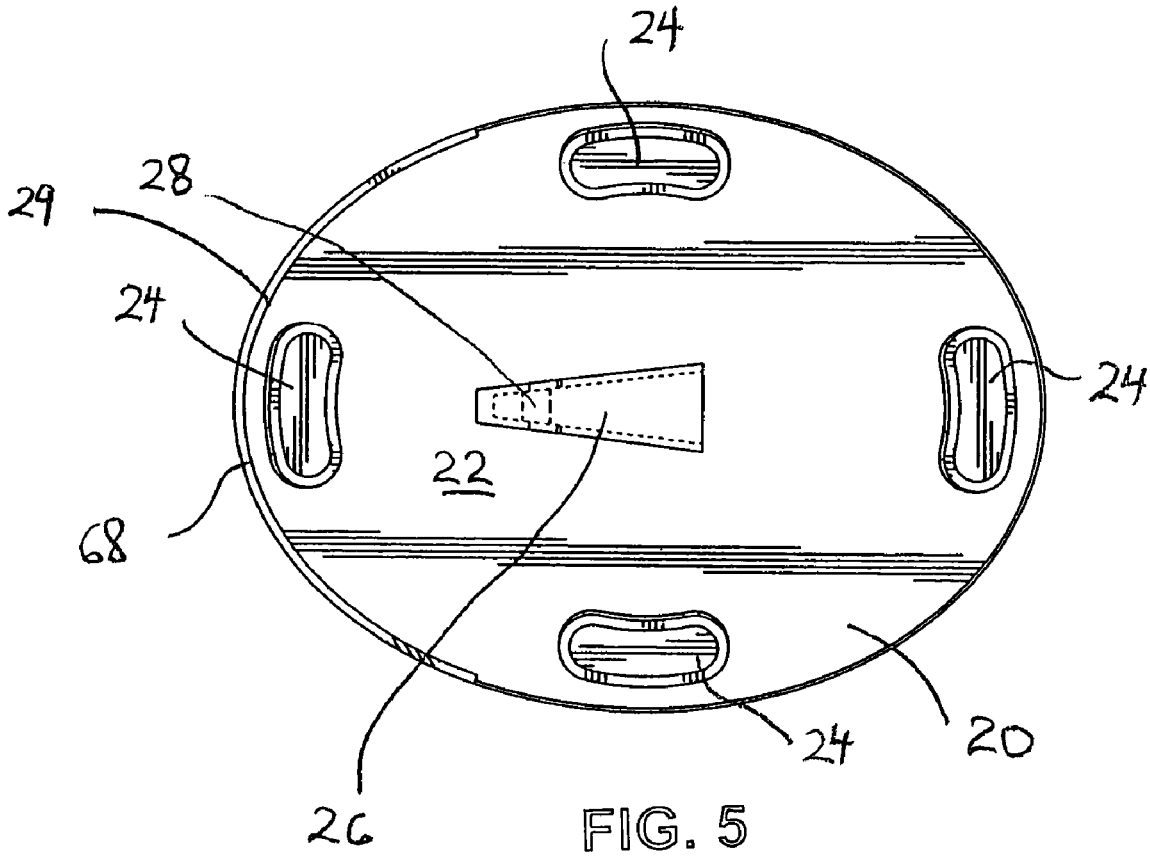
FIG. 5 is a bottom plan view of the pencil sharpener, portions being shown in phantom.
Figure 6:
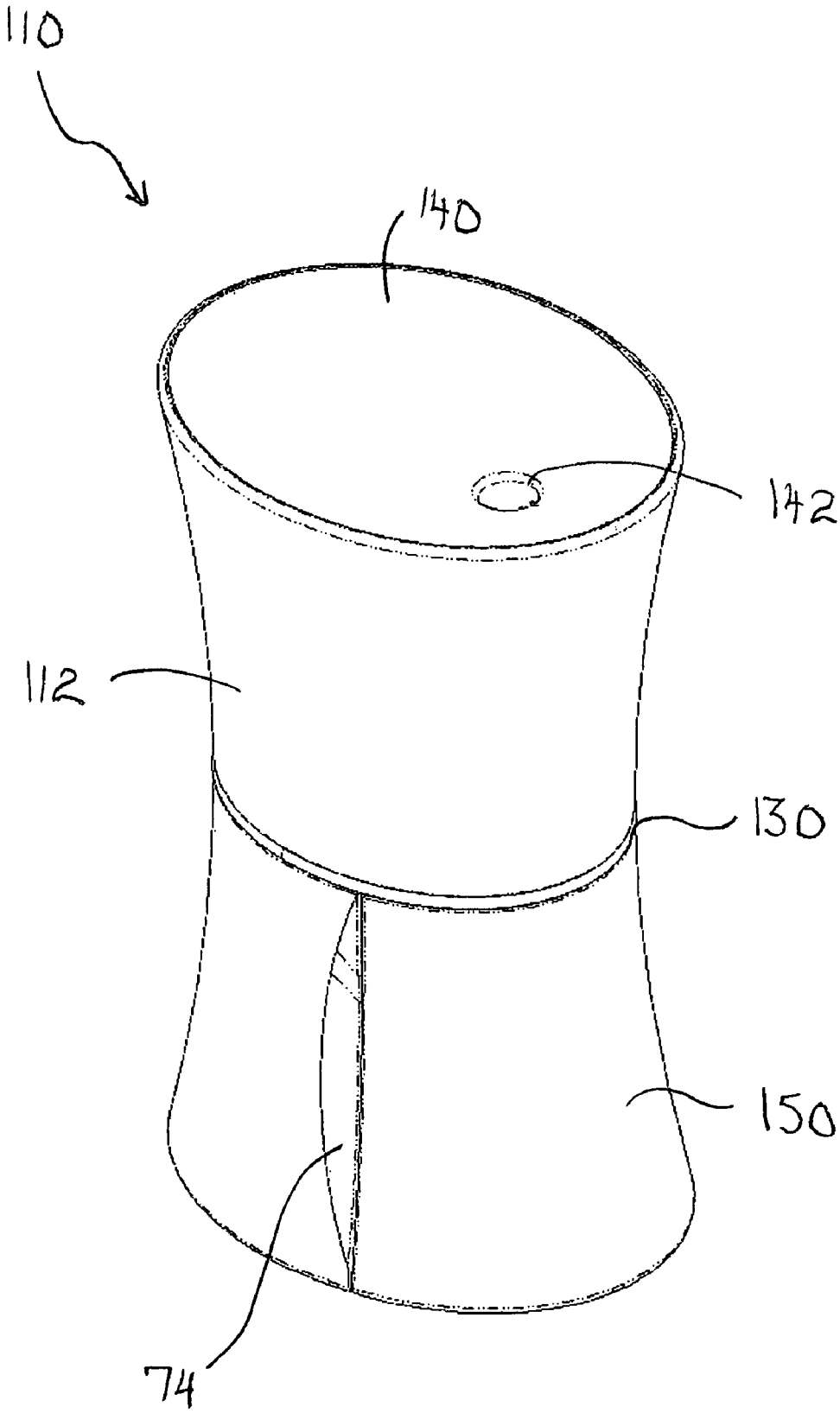
FIG. 6 is a perspective view of a second embodiment of a pencil sharpener.

With reference to FIG. 5, for pencil sharpener 10, the base 20 includes a generally elliptically shaped platform 22 with four arcuate support pads 24. An integral resilient tongue 26 with a distal catch 28 projects upwardly at a central location of the platform.

Figure 8:
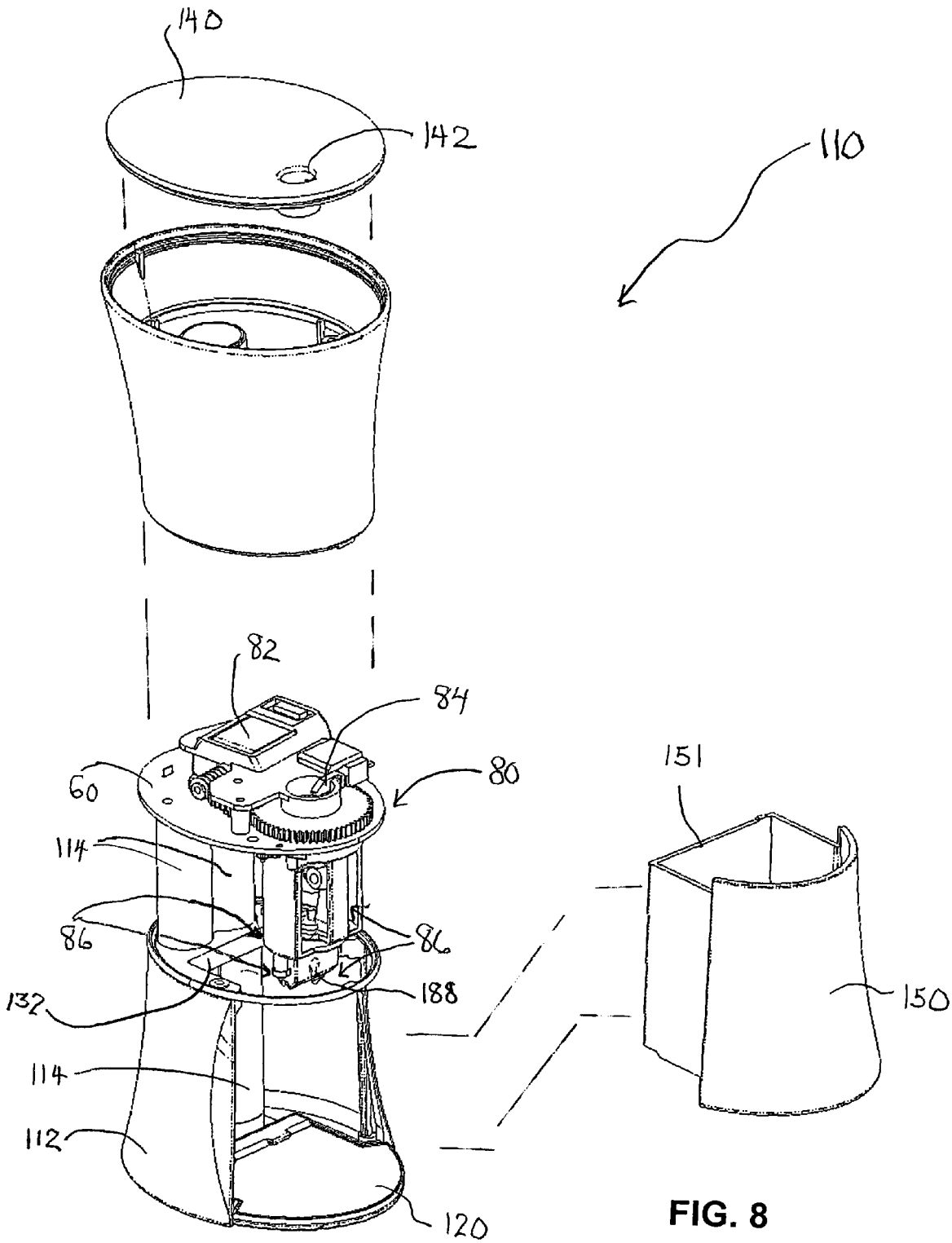
FIG. 8 is an exploded view, partly in schematic, of the pencil sharpener of FIG. 6.

With reference to FIG. 8, support platform 60 is mounted at an upper intermediate vertical position of the housing to provide a support for the electrically powered rotary cutter assembly 80. An electric motor 82 drives convergently angled cutters which cooperate to form the sharpened pencil point about a vertical axis. The foregoing components are not illustrated for pencil sharpener 10, but are substantially the same as those for pencil sharpener 110. The rotary cutter assembly 80 is mounted in a generally offset location relative to the central vertical axis of the housing. The central cutting axis is colinear with the pencil opening 42 or 142.

Figure 2:
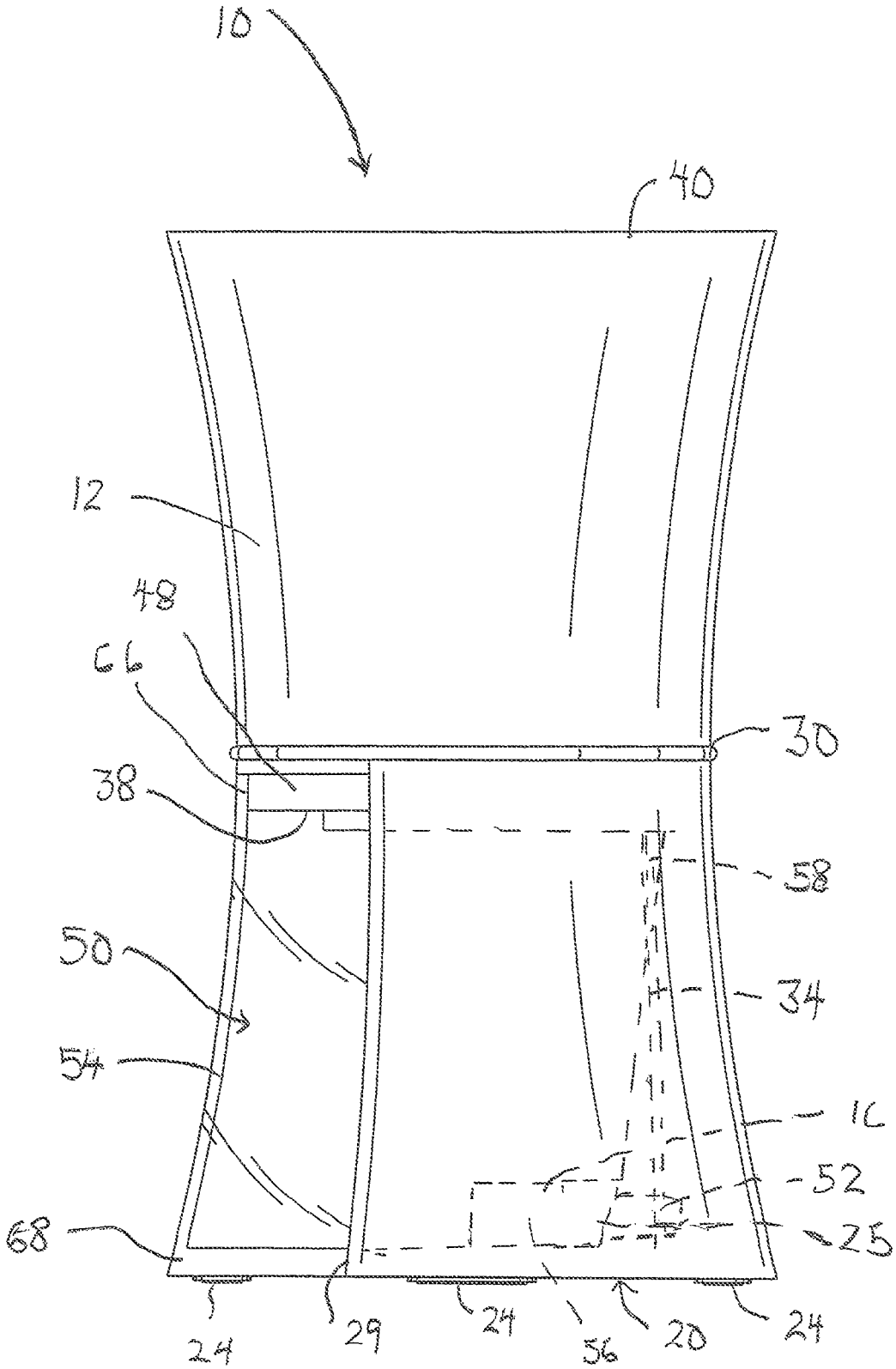
FIG. 2 is a side elevational view of the pencil sharpener of FIG. 1, portions being shown in phantom.
Figure 3:
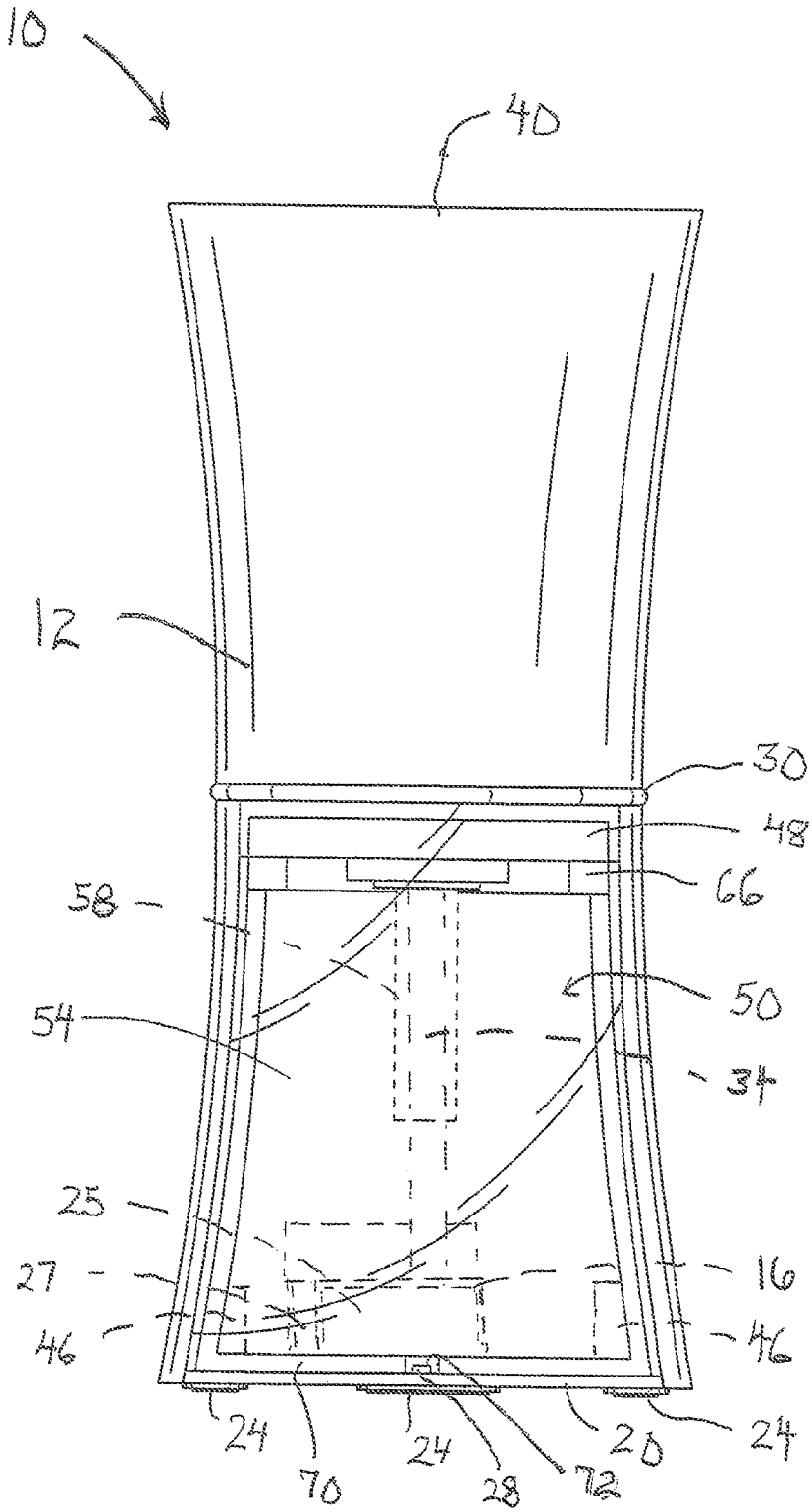
FIG. 3 is a front elevational view of the pencil sharpener, portions being shown in phantom.
Figure 4:
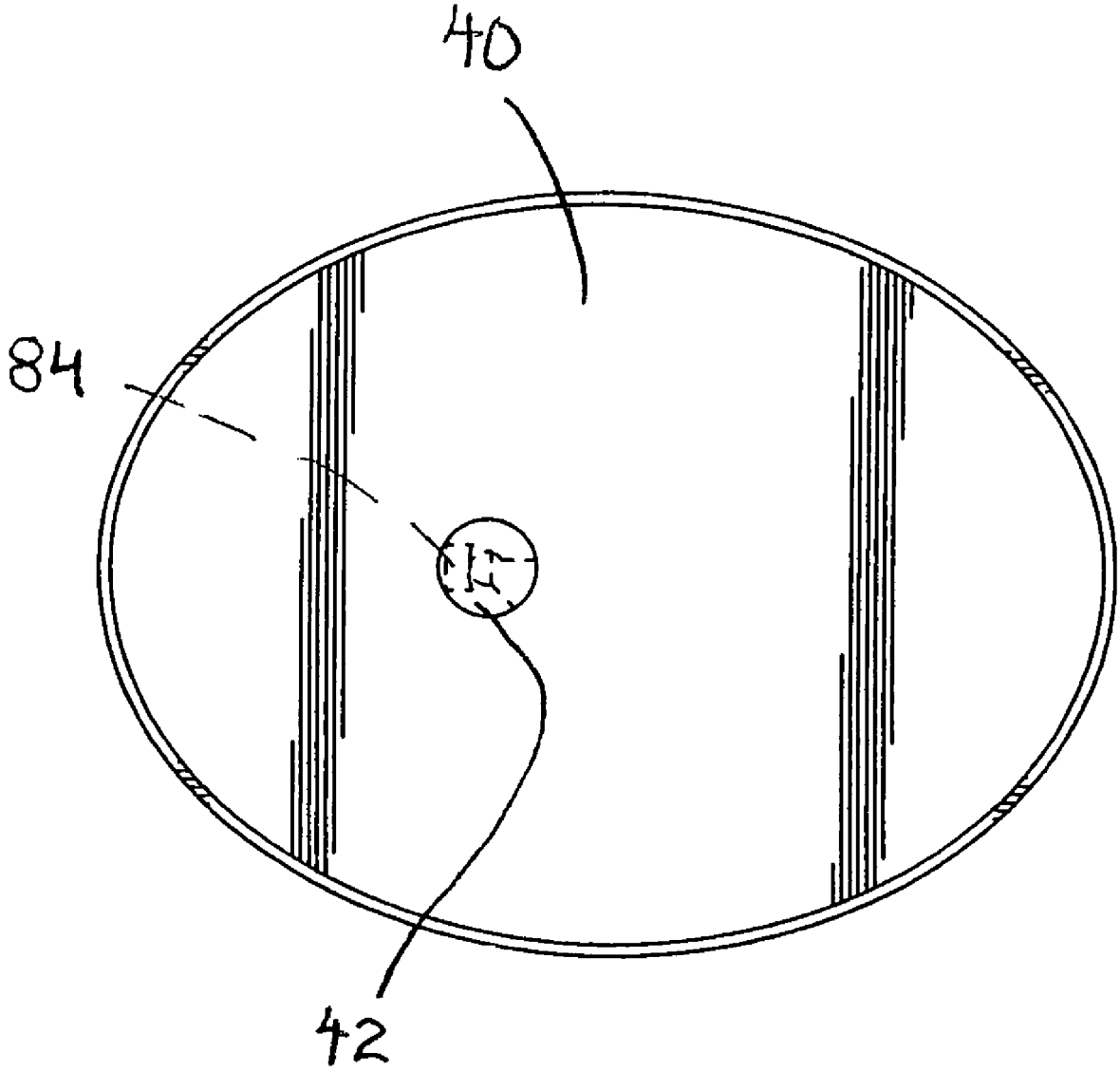
FIG. 4 is a top plan view of the pencil sharpener, portions being shown in phantom.

A rear lower exterior location of the housing 12 includes a small opening 23 for receiving an electrical power input. With reference to FIGS. 2 and 3, the interior of the housing has a lower molded box-like structure 16 which receives a switch 25 and includes a slot 27 for receiving a tab 52 rearwardly projecting from the receptacle drawer 50. The switch 25 is connected in series with the power input which communicates generally vertically upwardly with the motor 82 of the rotary cutter assembly. A protective strip 34 (FIG. 3) is typically employed to protect the electrical leads.

A lower end of the housing forms an opening 38 for the receptacle drawer. The receptacle drawer 50 is preferably a molded member which includes a frontal panel 54 having a shape which generally conforms to the exterior contours of the housing. The drawer 50 is opened at the top portion and is otherwise enclosed for retaining the shavings from the pencil sharpener. The frontal panel of the drawer 50 may be translucent or semi-transparent and function as a window so that the level of shavings may be visually observed from the exterior. The integral position tab 52 projects rearwardly from a lower location of the drawer.

The drawer 50 is generally complementary with the dimensions of the base and housing interior so that the drawer may be snugly slidably received and efficiently withdrawn from the housing. The drawer includes a pair of transverse channels 56 at a lower side portion which are engaged by integrally projecting locator bosses 46 at the base housing interior to facilitate the sliding movement of the drawer. The drawer also includes a rear indentation 58 which conformably accommodates the protective strip 34 at the rear of the housing interior.

An upper shield-like extension 66 of the frontal panel 54 of the drawer engages against an arcuate closure stop 48 of the housing. A shallow skirt 68 at the lower portion of the housing extends to engage against the front edge 29 of the platform. When the drawer is fully received in the housing, the drawer appears to present a seamless continuum with the housing, and the tab 52 is received in the sensor switch slot 27 and engages an arm of the switch.

With reference to FIG. 3, the bottom panel 70 of the drawer includes a central indentation 72. Upon closing so that the drawer is fully received by the housing, the catch 28 of the leaf spring tongue 26 is captured between walls of the indentation 72. The sides of the housing adjacent the fully received drawer include shallow quasi-crescent shaped indentations 74 (best illustrated in FIG. 6) to facilitate the grasping of the drawer to efficiently effect withdrawal of the drawer from the housing.

The rotary cutter assembly 80 is responsive to a switch 84 at the top of the housing which senses the insertion of the end of the pencil and energizes the motor 82 to rotatably drive the cutter assembly. A second switch terminates the cutting and/or the sharpening is terminated upon withdrawing the pencil from the sharpener.

It will be appreciated that the shavings and cuttings from the pencil will be thrown outwardly into the chute 86 (best illustrated in FIG. 8) formed between the cutting assembly and the interior of the housing so that the shavings will fall into the receptacle drawer 50. When the level of the shavings in the receptacle is sufficiently full, the receptacle drawer may be slidably removed and emptied in a conventional fashion. The presence of the position switch 25 interrupts power whereby the motor 82 will not be activated unless the receptacle drawer is fully received in the housing to collect the shavings.

Figure 9:
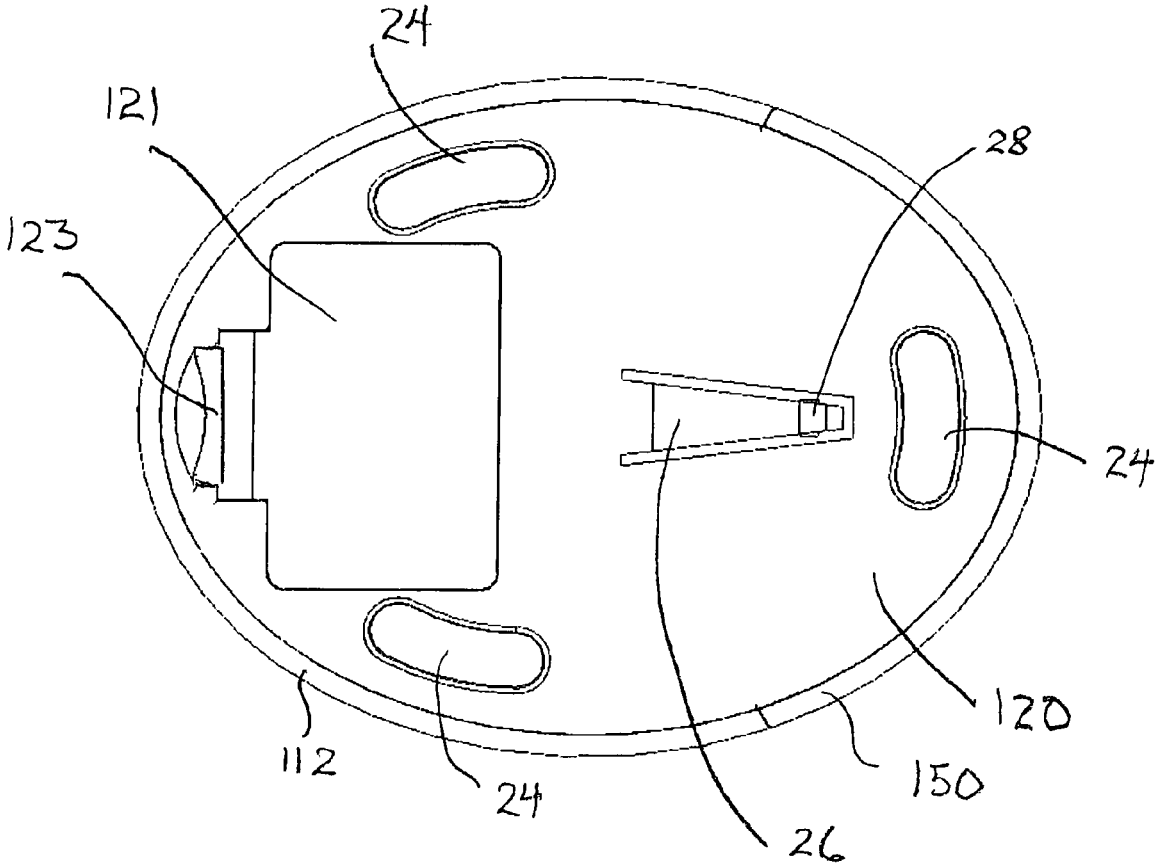
FIG. 9 is an enlarged bottom plan view of the pencil sharpener of FIG. 6.

With reference to FIGS. 6-9, a battery powered pencil sharpener is generally designated with the numeral 110. The pencil sharpener 110 includes a vertically extending battery compartment 114 which generally has a pair of cylindrical tubes that extend from the base to the top. In a preferred form, four AA 1.5 volt alkaline batteries are employed to power the sharpener. With reference to FIG. 9 the base 120 includes a cover 121 with a resilient tab 123 which is received in a slot for providing access to the battery compartment 114.

The receptacle drawer 150 is truncated at its rear portion 151 to accommodate the battery compartment. The rotary electrically driven sharpener is essentially suspended from the underside of the mounting platform 60. The opening 142 is offset from the center in the same manner as that of an electrically powered pencil sharpener 10.

Figure 7:
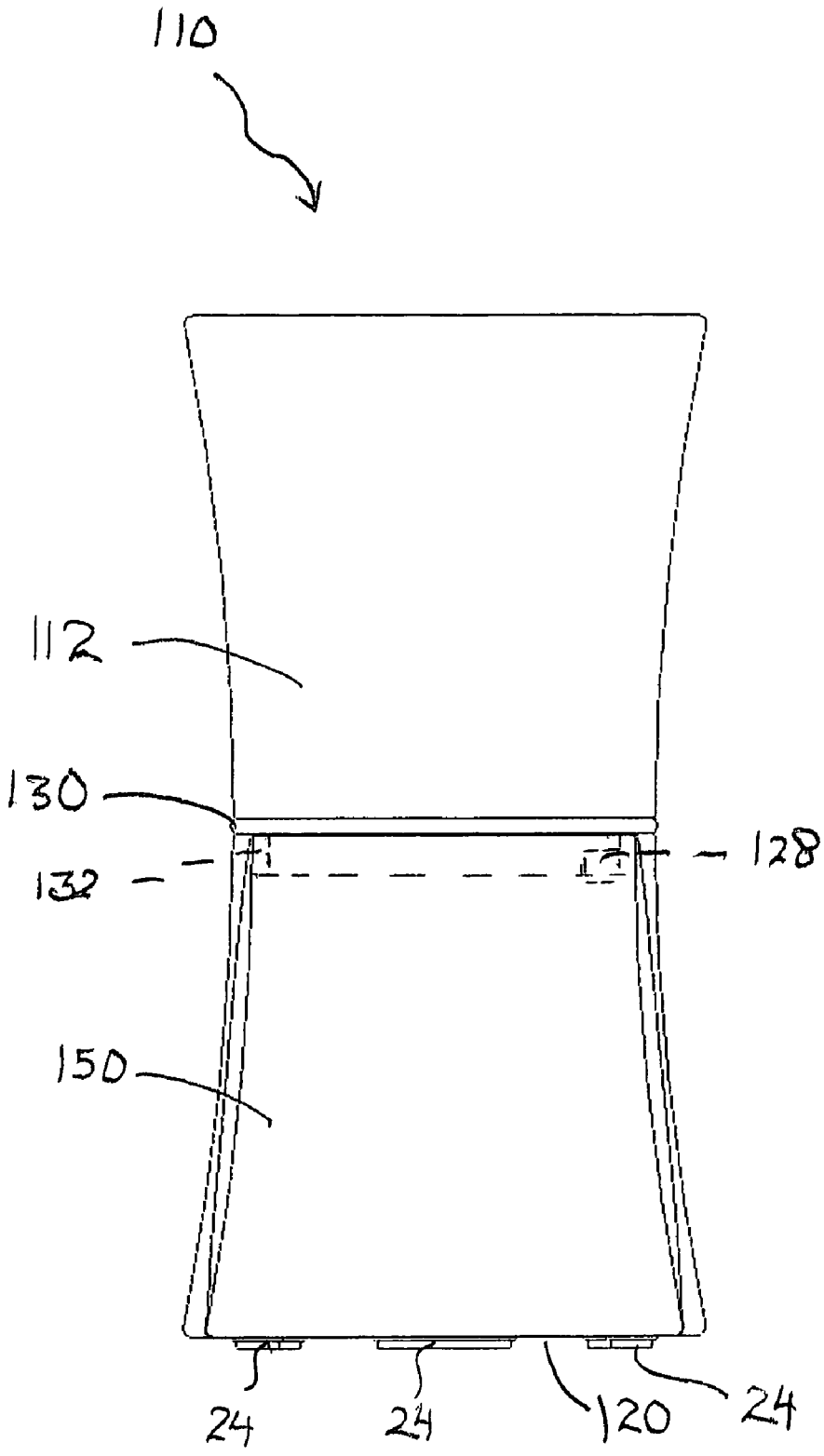
FIG. 7 is a front view of the pencil sharpener of FIG. 6, portions being shown in phantom.

A collar 132 at the intermediate location mounts a downwardly biased leaf switch 128 (FIG. 7). The leaf switch 128 closes a circuit when the receptacle drawer is inserted into the hosing in a closed position. The pencil sharpener 110 includes the switch 84 in an upper portion so that when a pencil is inserted into the pencil opening 142, the sharpener assembly is automatically activated and the sharpening process begins. Of course, the motor 82 may only be activated if the drawer sensing switch 128 is closed.

Once again, the interior of the upper and medial portions of the housing functions as a chute 86 which allows the shavings to fall into the receptacle provided by the drawer 150. In the event that a pencil lead point would become lodged in the rotary sharpening assembly, the receptacle drawer may be removed and the pencil sharpener turned over. The point can be removed by pressing a switch 188 at the bottom portion of the sharpener assembly.

Other than the specifically described features of pencil sharpener 110, the pencil sharpener 110 is substantially similar in form and function to that of pencil sharpener 10.

While preferred embodiments of the foregoing invention have been set forth for purposes of illustration, the foregoing description should not be deemed a limitation of the invention herein. Accordingly, various modifications, adaptations and alternatives may occur to one of ordinary skill in the art without departing from the spirit and the scope of the present invention.

The invention claimed is:

1. A pencil sharpener comprising:

a housing comprising a base and an axially spaced top surface defining an opening, said housing being disposable in a generally upright orientation supported on said base and a receiving cavity in said housing and communicating with said opening for receiving a pencil in an upright orientation generally orthogonal to the base and top surface, said top surface disposed generally parallel to said base, said base having a platform with a resilient tongue having a catch;

a receptacle having an open top and being transversely slidably receivable in said housing between an open position and a closed position wherein said receptacle is substantially fully received in said housing and having an indentation in a bottom portion of said receptacle, said indentation being engaged by said catch in the closed position;

an electrically operated sharpener assembly disposed in said housing above said received receptacle and below said top surface; and a first switch disposed in said housing and responsive to the insertion of an end of a pencil into said receiving cavity;

so that when a pencil end is axially inserted into said opening and receiving cavity and said receptacle is disposed in a closed position, said sharpener assembly is activated to sharpen said pencil and shavings from said pencil fall into said receptacle.

2. The pencil sharpener of claim 1 and further comprising a second switch responsive to the closed position of the receptacle and wherein the second switch prevents activation of the sharpener assembly when the receptacle is displaced from the closed position.

3. The pencil sharpener of claim 1 wherein the receptacle is a drawer with a frontal surface which is transparent or semi-transparent.

4. The pencil sharpener of claim 1 wherein the top surface and the base each have a generally elliptically shaped edge.

5. The pencil sharpener of claim 1 wherein the top surface has a generally elliptical shape with a concave depression and defines a center, and the opening is offset from the center of the top.

6. The pencil sharpener of claim 1 wherein the receptacle has an integral tab which projects anteriorally and is received in a slot of the housing for detection by a second switch.

7. The pencil sharpener of claim 1 wherein the receptacle includes a pair of laterally spaced sides which include lower channels which engage a contoured, interior projection of the housing.

8. The pencil sharpener of claim 1 wherein the housing has opposed indentations adjacent a frontal surface of the receptacle in the closed receptacle position.

9. The pencil sharpener of claim 1 wherein the housing has an interior cavity which forms a chute for shavings produced by the sharpener assembly for directing the shavings to the receptacle.

10. A pencil sharpener comprising:

a housing comprising a base and an axially opposed top surface, said top surface defining a first opening, said housing being disposable in a generally upright orientation supported on said base with a generally hourglass shaped exterior extending between said base and top surface, said housing defining a second opening and having a pair of laterally spaced indentations adjacent said second opening;

a receptacle drawer having an open top portion and a contoured frontal surface, said receptacle drawer being transversely slidably receivable in said housing through said second opening to a closed position wherein said receptacle drawer is substantially fully received in said housing and said frontal surface is adjacent said indentations;

an electrically operated sharpener assembly disposed in said housing between said received receptacle and said top surface;

a switch disposed in said housing, said switch responsive to the closed position of the receptacle;

so that when a pencil end is inserted axially downwardly through said first opening into said receiving cavity, said sharpener assembly is activated to sharpen said pencil, and shavings from said pencil fall into said receptacle drawer, and when said drawer is displaced from the closed position, said switch interrupts power to said sharpener assembly.

11. The pencil sharpener of claim 10 wherein a second switch is disposed in said housing and said switch automatically activates the sharpener assembly when the receptacle drawer is in the closed position and the pencil end is inserted into said receiving cavity.

12. The pencil sharpener of claim 10 wherein the receptacle drawer frontal surface is transparent or semi-transparent.

13. The pencil sharpener of claim 10 wherein the base comprises a platform with a resilient tongue having a catch and the receptacle drawer has an indentation which is engaged by the catch in the closed position.

14. The pencil sharpener of claim 10 wherein the top surface and the base each have a generally elliptically shaped edge.

15. The pencil sharpener of claim 10 wherein the top surface has a generally elliptical shape with a concave depression and defines a center, and the first opening is offset from the center.

16. The pencil sharpener of claim 10 wherein the receptacle drawer has an integral tab which projects rearwardly and is received in a slot of the housing for detection by the switch.

17. The pencil sharpener of claim 10 wherein the receptacle drawer includes a pair of laterally spaced sides which include lower channels which engage a contoured, interior projection of the housing.

18. The pencil sharpener of claim 10 wherein the housing has an interior cavity which forms a chute for shavings produced by the sharpener assembly for directing the shavings to the receptacle drawer.

* * * * *